US005387053A

United States Patent [19]

Williamson

[11] Patent Number: 5,387,053

[45] Date of Patent: Feb. 7, 1995

[54] SPILL CONTROL APPARATUS FOR USE ON OFFSHORE OIL WELL DRILLING PLATFORMS

[75] Inventor: Pat Williamson, Morgan City, La.

[73] Assignee: B & P Environmental Services, Inc., Morgan City, La.

[21] Appl. No.: 122,059

[22] Filed: Sep. 15, 1993

[51] Int. Cl.[6] ..... A47L 9/00

[52] U.S. Cl. ..... 405/52; 405/107; 15/323; 206/386; 210/924

[58] Field of Search ..... 405/52, 60, 63, 107, 405/114, 115, 128, 129, 263; 210/690, 924; 15/323; 206/386; 264/41, 309; 425/DIG. 50

[56] References Cited

U.S. PATENT DOCUMENTS

| | | | |
|---|---|---|---|
| 3,401,420 | 9/1968 | Lofgren | 15/323 |
| 3,977,037 | 8/1976 | Miyake et al. | 15/323 X |
| 4,401,475 | 8/1983 | Eriksson et al. | 210/924 X |
| 4,492,001 | 1/1985 | Hedrenius | 210/924 X |
| 4,519,338 | 5/1985 | Kramer et al. | 405/129 X |
| 4,563,789 | 1/1986 | Berfield | 15/323 |
| 4,799,821 | 1/1989 | Brodersen | 405/52 X |
| 4,981,391 | 1/1991 | Klementovich | 405/52 |
| 4,989,291 | 2/1991 | Parent | 15/323 X |
| 5,011,330 | 4/1991 | Kittle et al. | 405/129 |
| 5,089,037 | 2/1992 | Marsolais | 15/323 X |
| 5,215,407 | 6/1993 | Brelsford | 210/924 |

FOREIGN PATENT DOCUMENTS

| | | | |
|---|---|---|---|
| 681242 | 5/1930 | France | 15/323 |

*Primary Examiner*—Randolph A. Reese
*Assistant Examiner*—John A. Ricci
*Attorney, Agent, or Firm*—Pravel, Hewitt, Kimball & Krieger

[57] ABSTRACT

A spill control cabinet for use in an offshore oil well drilling environment includes a structural frame that can be transported by lifting (using crane or forklift) and wherein a cabinet is formed on the frame having an interior. Articles are contained within the cabinet. Drums can be contained outside the frame on supports for containing absorbent materials used in spill control (oil and chemicals). The cabinet can contain a vacuum system for suctioning a spill and a foam dispensing system for containing spills.

9 Claims, 4 Drawing Sheets

FIG. 4
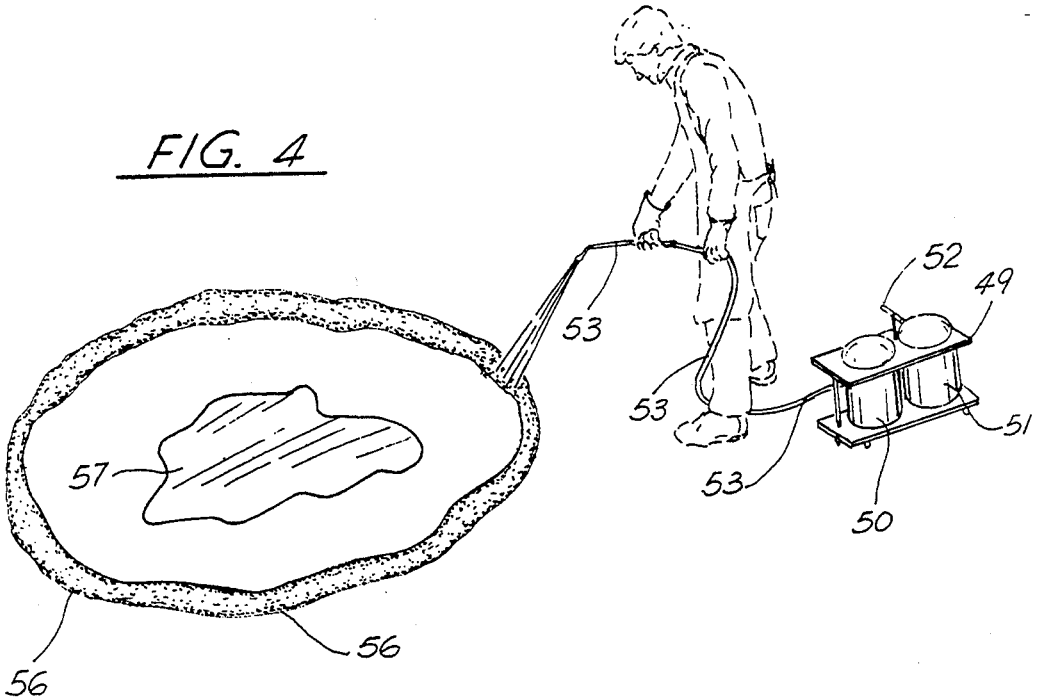
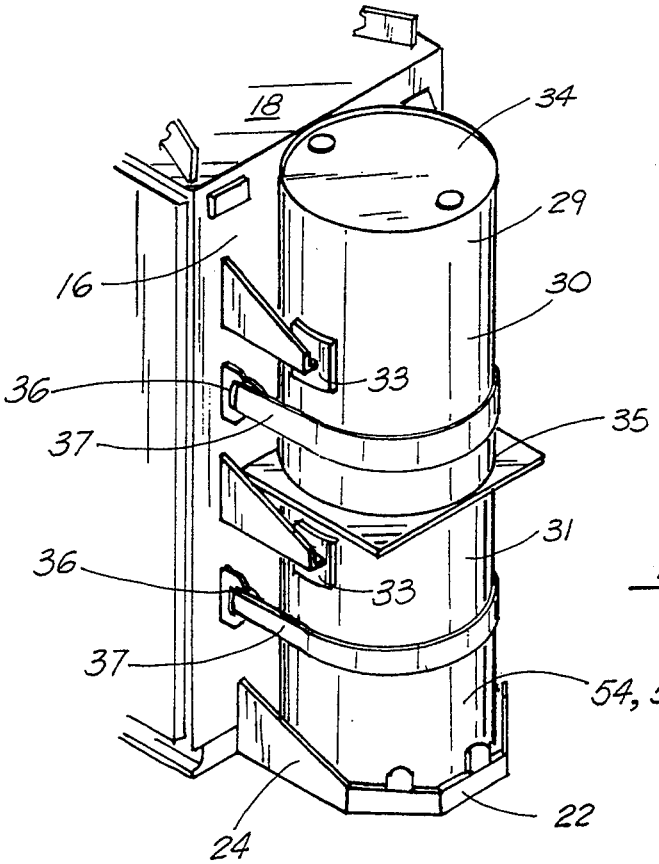
FIG. 3

SPILL CONTROL APPARATUS FOR USE ON OFFSHORE OIL WELL DRILLING PLATFORMS

BACKGROUND OF THE INVENTION

1. Field Of The Invention

The present invention relates to the clean-up of oil and chemical spills on offshore oil platforms and the like, and more particularly relates to an improved apparatus for speedy and comprehensive clean-up of oil, chemical and like spills on the decks of offshore oil drilling platforms. Even more particularly the present invention relates to an improved spill control apparatus that includes a frame having external supports for carrying multiple drums that can be used in spill clean-up operations and wherein the drums are loaded with an absorbent clean-up material during transit while functioning as receptacles for waste material at the clean up site.

2. General Background

In the offshore oil and gas clean-up industry there are a large number of platforms and like structures that are placed in an offshore environment. These platforms include drilling platforms that are used to drill for oil, and production platforms that are used to control the flow of oil and/or gas from undersea, underground oil and gas well.

One of the problems with oil drilling in an marine environment is the enormous environmental problem of the clean-up in the event of a spill.

One of the most important concepts of cleaning-up a spill in an offshore oil environment is to reduce or contain the spill as quickly as possible. A basic plan of action on the oil rig is to complete a speedy clean-up before any oil reaches the surrounding marine environment. The environmental consequences are much greater once oil reaches the ocean water under the rig. Such a spill of oil kills marine animals and pollutes the area that marine animals occupy for a long period of time if the spill is substantial.

One important problem with spill control on a deck of an oil rig is to supply an adequate amount of equipment in one place that is especially allocated for spill clean-up. Further, the equipment must be quickly movable from one location to another.

Offshore oil and gas well drilling rigs may drill wells over existing platforms. If a spill originates from the platform, action must be taken quickly. The platform emergency shut down loop must be pulled which will shut off most sources of spills on the platform immediately. The platform operator should then be notified of the spill and then decide if preventative action must be taken.

Another common source of spills on offshore oil and gas well drilling rigs is the diesel take-on hoses. An oil field worker stationed to watch the hose transfers will immediately notify both the rig pump room and the boat to shut their pumps off at the pertinent time. All valves on each side of the hose, the rig and the boat will then be closed.

Drilling mud pits filled with an oil based mud sometimes have leaking dump valves. Because of the foredescribed combination of fluids that are handled on an offshore oil and gas well drilling rig, there is a need of a simple, yet workable solution to the problem of spills generated on the deck of a rig in order to contain and clean those spills before they reach the underlying sea water.

SUMMARY OF THE PRESENT INVENTION

The present invention provides an improved spill control apparatus in the form of a spill control locker or cabinet that can be lifted quickly from a work boat or other marine vessel to a rig deck and then moved quickly from location to location on the rig deck. Movement of the apparatus on the rig deck can be with an overhead crane, lift crane, or fork lift type device.

The apparatus can include a frame that has a pair of opposed carriages for supporting multiple cylindrical drums. These drums are desirably filled with an absorbent clean-up material when the apparatus is initially transported to the rig deck. This allows the drums to be very quickly removed from the apparatus. The drums can be used to dispense absorbent material that is used in the clean-up. The empty drums function as a receptacle for contaminated material once the clean-up is completed.

One of the features of the present invention is an apparatus that includes a housing in the form of a cabinet that separates certain spill control articles contained internally of the housing, away from the external drum containers. This insures a clean contamination free environment for new spill control material that has not yet been used, and receptacles for holding any collected contaminated material (such as absorbent plus spilled oil or chemical).

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein:

FIG. 3 is a fragmentary view of the preferred embodiment of the apparatus of the present invention; and FIG. 4 is a schematic fragmentary view of the foam dispenser rack portion of the apparatus of the present invention.

DETAILED DESCRIPTION OF THE PREFERRED EMBODIMENT

Figure 1:
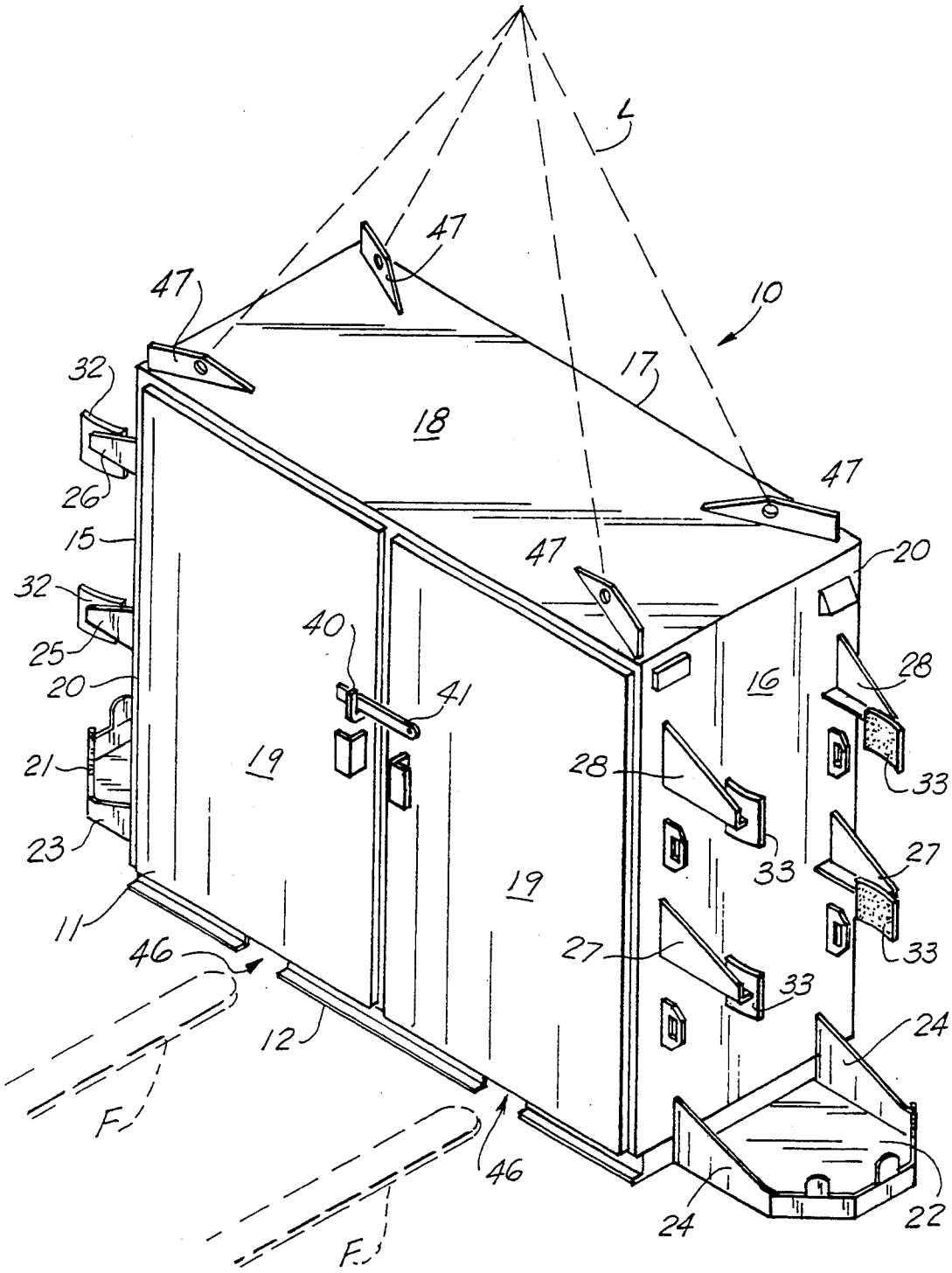
FIG. 1 is a perspective view of the preferred embodiment of the apparatus of the present invention.
Figure 2:
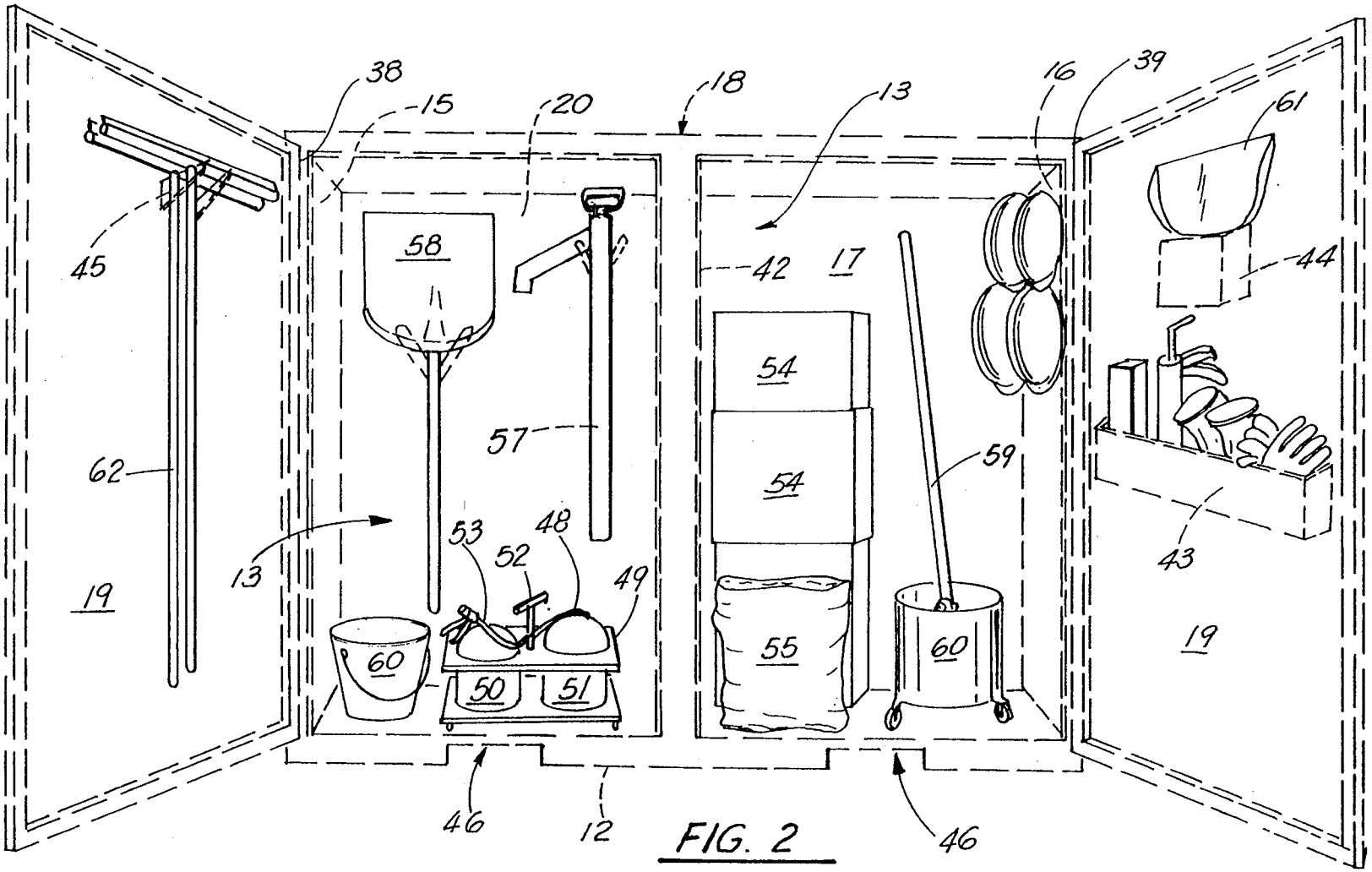
FIG. 2 is a sectional elevational view of the preferred embodiment of the apparatus of the present invention.
Figure 5:
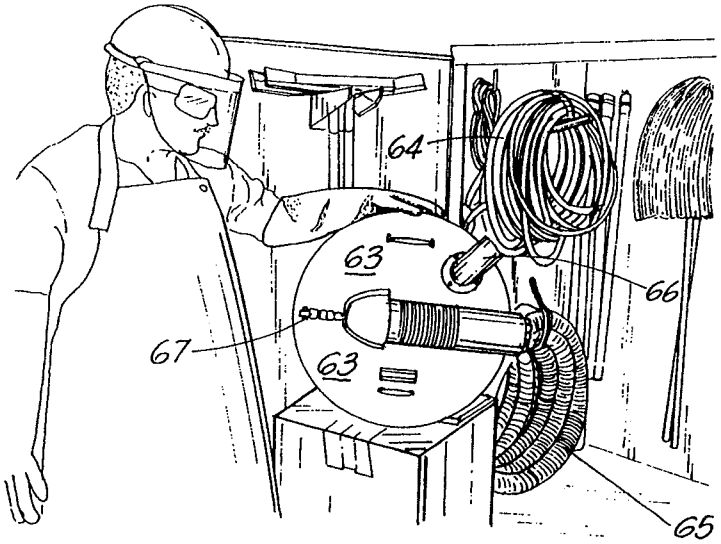
FIGS. 5–7 are perspective fragmentary views of the preferred embodiment of the apparatus of the present invention.

FIGS. 1–3 show generally the preferred embodiment of the apparatus of the present invention designated generally by the numeral 10. Spill control locker apparatus 10 includes a structural frame 11 having a flat bottom wall or base 12. The frame 11 defines a cabinet 20 or locker that is comprised of base 12, side walls 15, 16, rear wall 17, top 18 and doors 19.

Cabinet 20 is used to contain a plurality of spill control items within interior 13 and a protected pollution free environment. The frame 11 also supports a pair of exterior platforms 21, 22. Each of the platforms 21, 22 is attached by welding for example to base 12 and an adjacent side wall 15, 16 using gussets 23, 24 respectively.

A plurality of cradles are provided for forming an interface between the side wall 29 of drums 30–31 and a side wall 15, 16. Cradles 25, 26 extend above platform 21 at vertically spaced apart locations. The cradles 27, 28 extend above platform 22 at vertically spaced apart locations. Each of the cradles provide curved pads 32, 33 that abut a drum 30–31 during use. A plurality of four drums 30–31 are provided including a pair of drums 30, 31 supported by platform 21 and a pair of drums 32–31 supported by platform 22.

Each of the drums 30–31 includes a generally cylindrically shaped drum sidewall 29 and a pair of drum ends 34, 35. A plurality of padeyes 36 are positioned at vertically spaced apart and at horizontally spaced apart positioned on side walls 15, 16. The padeyes 36 form attachments for straps 37 that are used to retain each of the drums 30–33 in a stacked operative position as shown in FIG. 1.

The pair of doors 19 are movably affixed to the frame 11 using hinges 38, 39. A pair of door latch members 40, 41 are used to close the doors 19. The interior 13 of cabinet 20 provides a central vertically extending wall 42 and one or more shelves 43 can be mounted within interior 13, on a wall 15, 16, 17 for example, or upon a door 19. A plurality of receptacles 44–45 can be provided for hanging articles at desired positions within interior 13. The entire apparatus 10 can be lifted using a forklift type lifting mechanism F. A pair of rectangular, spaced apart slots 46 are provided at a distance apart that corresponds to the tines of a fork lifting device F. The apparatus of the present invention can also be lifted using a crane or like lifting harness attached to lifting eyes 47 that are positioned at the corners of wall 18 as shown in FIG. 1. Lifting lines are simulated by phantom lines L in FIG. 1.

The apparatus of the present invention provides an interior 13 portion of cabinet 20 for holding a plurality of spill control articles. One of the articles preferably includes a foam unit 48 that is in the form of a rack 49 that can be hand carried using handle 52. The rack 49 carries a pair of tanks 50, 51 that are in fluid communication. The foam unit 48 has a dispensing hose 53 for dispensing a foam product that can form an elongated boom around a spill as shown in FIG. 4.

A number of spill control articles are used to absorb chemicals and oil that have been spilled. These include loose bulk absorbent 54, absorbent rectangular pads 55, and elongated absorbent booms 56 all commercially available under the trademark Sphag-Sorb. With the present invention, the bulk absorbent 54, the absorbent pads 55, and the absorbent boom material 56 can be prepackaged in multiple drums 30, 31 before the apparatus 10 is dispensed to a desired location. Additionally, bulk absorbent 54 can be transported in boxes as shown in FIG. 2 carried in the interior 13 of cabinet 20. Absorbent pad 55 can also be carried in interior 13, as an addition to absorbent boom members 56 carried within drums 30, 31.

Figure 7:
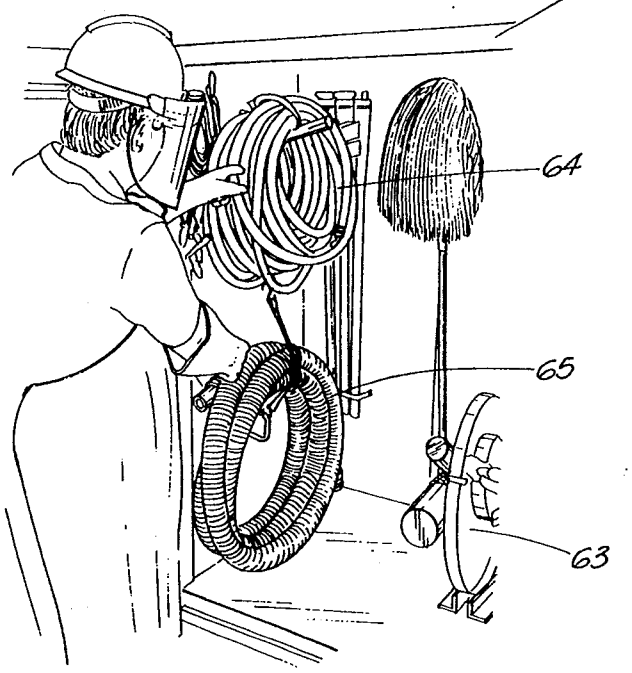
Figure 6:
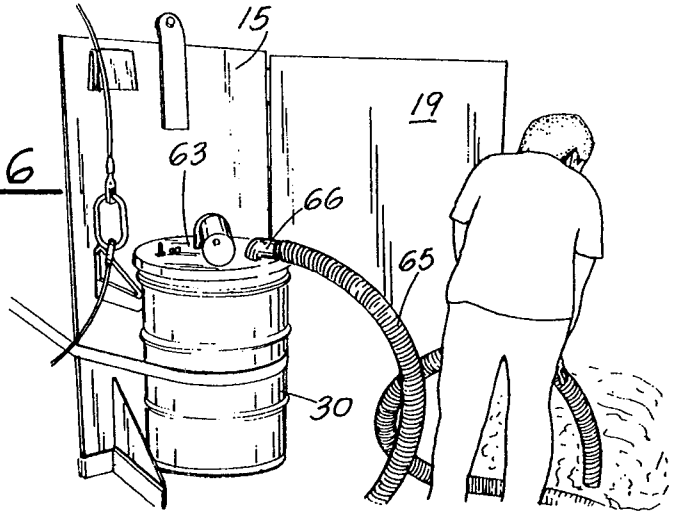

Other useful spill control articles can be included in kit form within the interior 13 of cabinet 20. Some of those spill control articles that are shown in the drawings include babin pump 57, shovel 58, oil mop 59, bucket 60, dust pan 61, wet broom 62, and wet/dry vacuum 63. Wet/dry vacuum 63 is commercially available and is adapted to attached to the top of a drum 30, 31 replacing the drum in 34 as shown in FIG. 6. As part of the apparatus of the present invention, the wet/dry vacuum 63 is preferably pneumatically driven using air hose 64 that can be connected to rig air or another comparable compressed air or like pneumatic source. Large suction hose 65 fit the wet/dry vacuum 63 at fitting 66. As shown in FIG. 6, the wet/dry vacuum can be installed upon a drum 30, 31 even when the drum is still attached to platform 22. The wet/dry vacuum includes fittings 66, 67 for respectively forming connection with air hose 64 and suction hose 65. As shown in FIG. 7 the wet/dry vacuum 63 can be stored within interior 13 of cabinet 20.

The locker 20 is preferably an all aluminum locker that is about $11\frac{1}{2}\times6'\times3'$ and is preferably less than 2000 lbs. in weight fully equipped. Spill control articles and their use are summarized as follows:

One (1) compressed air powered vacuum generating head to fit and mount on standard (DOT) 55 gallon drum 30–31, instantly transforming into high-volume industrial vacuum to handle the toughest clean-up with speed and east. The suction power is such that you can pick-up virtually anything that will pass through the $2''\times25'$ static conductive hose including dirt, sand, chips, water, oil etc. Accessories include a $100'\times\frac{3}{4}''$ H.D. poly-air hose with crowsfoot quick-connect fittings, wt or dry floor tool, crevice tool, liquid shut off, and gulper wand.

Four DOT drums with air release bongs and SS bolts to avoid gaulding

Two $2''\times27'$ ratcheting nylon tie downs to hold each of the drums 30–31 securely.

Four oil mops including two (2) mounted on all aluminum heads with extending handles to 10' and two (2) mops for replacements.

Four MINE SAFETY adjustable hard helmets, with full clear face shields attached and four chemical resistant sets of goggles.

Four 32 oz. cotton mops for other than hydrocarbon type cleaning.

Two mop buckets and wringers.

Two grounding cables with clips.

Four 24" curved floor squeegees.

Four H.D. yellow neoprene aprons.

One roll 2" masking tape.

Four sets H.D. orange neoprene gloves.

One roll 2" duct tape.

Four aluminum scoop/shovels.

Two all aluminum dust pans.

One roll 1000' of 3" CAUTION warning tape to seal & secure spill.

Three galvanized Babin pumps.

Four 14 qt. galvanized round pails.

Four H.D. frame caulking guns.

Ten tubes of clear silicone caulk.

One portable Froth-Pak 180 kit.

This includes a rack for ease of carrying, handling, and dispensing. The foaming kit provides a ployurethane foam dispensing system. The foam produced by this is organic and can be used to repair, patch, fill void areas and situations that might allow leakage of spills. It drys rapidly and may be used to boom. It preferably yields 200 bd. ft. of product under normal conditions.

Fifteen $4''\times8'$ absorbent filled sock booms, commercially available for Sphag-Sorb (attached should produce approximately 120' of boom—which should encircle approximately 40' of spill areas.

One hundred and fifty $10''\times20''$ absorbent peat (e.g. commercially available from Sphag Sorb) filled pads.

Two bags of 4 cubic foot compressed filled loose absorbent peat litter, commercially available from Sphag-Sorb.

Absorbent peat is a safe, non-toxic, non-leaching organic product and biodegradable for the environment. It does not require trained technicians nor specialized equipment for application of extraction. It can be incinerated or disposed of in landfills while reducing landfill disposal cost and relieving concerns about leaching and ground water contamination. It is an efficient vapor suppressant. When used in conjunction with a quality emulsifier on flammable liquid spills, it eliminates the escape of explosive vapors. It absorbs and encapsulates oils and organic solvents and is an invaluable first response tool for all emergency situations. It is nonabrasive and can be easily cleaned up by sweeping, squeezing, or vacuuming after extraction. It leaves no messy residue. Absorbent peat encapsulates hydrocarbons, including PCB/s, on contact, taking in the oils rather than merely allowing the oil to attached to the surface of the product. It acts in various capacities, absorbing hydrocarbons on land, form drums, from hard surfaces and on water, etc.

Twelve cartons of slip resistant ash/powder absorbent (non-slip)

The following table lists the part numbers and part descriptions as used herein and in the drawings attached hereto.

PARTS LIST

| Part Number | Description |
|---|---|
| 10 | spill control locker apparatus |
| 11 | frame |
| 12 | base |
| 13 | interior |
| 14 | top wall |
| 15 | side wall |
| 16 | side wall |
| 17 | rear wall |
| 18 | top wall |
| 19 | door |
| 20 | cabinet |
| 21 | platform |
| 22 | platform |
| 23 | gusset |
| 24 | gusset |
| 25 | cradle |
| 26 | cradle |
| 27 | cradle |
| 28 | cradle |
| 29 | drum cylindrical wall |
| 30 | drum |
| 31 | drum |
| 32 | curved pad |
| 33 | curved pad |
| 34 | drum end |
| 35 | drum end |
| 36 | padeye |
| 37 | strap |
| 38 | hinge |
| 39 | hinge |
| 40 | door latch |
| 41 | door latch |
| 42 | vertical wall |
| 43 | shelf |
| 44 | receptacle |
| 45 | receptacle |
| 46 | rectangular slot |
| 47 | lift eyes |
| 48 | foam unit |
| 49 | rack |
| 50 | tank |
| 51 | tank |
| 52 | handle |
| 53 | dispensing hose |
| 54 | bulk absorbent |
| 55 | absorbent pads |
| 56 | absorbent boom |
| 57 | babin pump |

-continued

PARTS LIST

| Part Number | Description |
|---|---|
| 58 | shovel |
| 59 | oil mop |
| 60 | bucket |
| 61 | dust pan |
| 62 | wet broom |
| 63 | wet/dry vacuum |
| 64 | hose |
| 65 | suction hose |
| 66 | fitting |
| 67 | fitting |
| F | forklift tines |
| L | lifting lines |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A spill-control kit comprising:

a) a structural frame made of chemical resistant material that supports a cabinet with an interior for holding at least a plurality of spill control articles;

b) the frame providing a first rack portion externally of the interior;

c) the frame providing second rack portion externally of the interior;

d) a first plurality of storage drums removably secured to a selected area of the racks;

e) an absorbent material contained within at least one of the drums;

f) a polyurethane foam dispensing system for dispensing foam to form a barrier around a spill; and g) wherein the frame has a load capacity of at least one thousand pounds.

2. The spill-control kit of claim 1, wherein the chemical-resistant material is aluminum.

3. The spill-control kit of claim 1, wherein the absorbent material is an organic industrial absorbent.

4. The spill-control kit of claim 1, wherein the drums provide a capacity of at least one hundred gallons.

5. The spill-control kit of claim 1, wherein the plurality of articles includes a wet/dry vacuum cleaner that can be operated by compressed air.

6. The spill-control kit of claim 5, wherein the wet/dry vacuum cleaner means comprises a compressed-air powered vacuum generating head that can be removably mounted upon one of the drums.

7. The spill-control kit of claim 1, wherein the cabinet has an interior space of at least one hundred cubic feet.

8. The spill-control kit of claim 1, wherein the frame includes forklift slots and lifting eyes for rapid attachment to lifting cables.

9. A method of containing a chemical or hydrocarbon spill, comprising the following steps:

a) transporting a spill control kit into the vicinity of the spill, the spill control kit comprising:

i) a cabinet, made of a chemical-resistant material and having an interior for holding spill control articles;

ii) at least one support rack;

iii) a wet/dry vacuum cleaner means supported externally of the interior;

iv) at least one storage drum removably secured to the rack;

v) absorbent material contained within the drum;

vi) a polyurethane foam dispensing system for dispensing at least one hundred (100) board feet of polyurethane foam;

vii) multiple articles of protective clothing for protecting an operator's hands, arms, head, torso;

b) using the wet/dry vacuum cleaner to vacuum up at least part of the spill;

c) using absorbent material contained in the first drum to absorb at least some of the spill;

d) using the foam to form a barrier around at least a portion of the spill.

* * * * *